US005184708A

United States Patent [19]

Levasseur

[11] Patent Number: 5,184,708

[45] Date of Patent: Feb. 9, 1993

[54] VEND TRANSACTION CONTROL MEANS

[75] Inventor: Joseph L. Levasseur, St. Louis County, Mo.

[73] Assignee: Coin Acceptors, Inc., St. Louis, Mo.

[21] Appl. No.: 842,248

[22] Filed: Feb. 27, 1992

[51] Int. Cl.[5] ..... G07D 1/06

[52] U.S. Cl. ..... 194/217; 453/2; 453/17

[58] Field of Search ..... 194/217, 218; 453/2, 453/17; 235/7 A

[56] References Cited

U.S. PATENT DOCUMENTS

| | | | |
|---|---|---|---|
| 3,820,642 | 6/1974 | Levasseur | 194/217 |
| 3,894,220 | 7/1975 | Levasseur | 194/218 X |
| 3,963,035 | 6/1976 | Levasseur | 194/216 X |
| 4,188,961 | 2/1980 | Heiman | 194/216 X |
| 4,191,999 | 3/1980 | Kashio | 235/7 A X |
| 4,347,924 | 9/1982 | Hayashi et al. | 194/346 |
| 4,462,512 | 7/1984 | Schuller | 194/217 |
| 4,499,985 | 2/1985 | Schuller | 194/217 |
| 4,587,984 | 5/1986 | Levasseur et al. | 194/216 X |
| 4,763,769 | 8/1988 | Levasseur | 194/217 |
| 5,092,816 | 3/1992 | Levasseur | 453/17 |

*Primary Examiner*—F. J. Bartuska

*Attorney, Agent, or Firm*—Haverstock, Garrett and Roberts

[57] ABSTRACT

The present invention comprises an apparatus for controlling the vending and payback of change in a vending machine and includes a device for establishing a list of permissible payback amounts from the vending machine and for adding each of the permissible amounts to a vend price established by a customer selecting a particular vend, and a payback storage device from which change is paid back including apparatus for determining the availability of coins in the payback storage device to satisfy the permissible amount for payback.

18 Claims, 5 Drawing Sheets

VEND TRANSACTION CONTROL MEANS

Various methods have been devised to provide change to a customer from a vending machine when he has deposited coins or bills for making a transaction which exceeds the price of the product selected.

U.S. Pat. No. 4,763,769 assigned to applicant's assignee, provides the feature of returning the denomination or denominations deposited when change is required that is not available. At this time the customer is directed to use the exact change to obtain a vend. He may be also allowed to over deposit if he still cares to after notification of insufficient change capability. This feature is possible when the price is known before the deposit is made.

Other methods such as taught in U.S. Pat. Nos. 3,894,220 and 3,963,035, also assigned to Applicant's assignee, show means for subtracting the selection price from the amount deposited (credit) to determine the total amount of change that is required. The required change is provided from self loading coin tubes which are activated according to the availability of the coin denominations needed for payout.

Another method is shown in U.S. Pat. No. 4,188,961 which compares the vend price with the amount of credit to totalize the required change and then examines the coin tube change availability to provide a vend if sufficient change can be made. The main feature is to provide that the full credit is returned to the customer when change is insufficient by using a single output line to provide two different functions by utilizing two different signal characteristics (such as two different frequencies) provided thereon and a discriminator to distinguish between the two signals.

Another method of providing change requirements is shown in U.S. Pat. No. 4,499,985 wherein coins and bills are integrated into the process of making change. Again the amount of change required is determined by substracting the selection price from the amount of credit deposited. A further stipulation is that a vend requiring more than the first predetermined amount of change is allowed only if an item of money of a denomination greater than the amount of change required has been deposited in the vendor.

U.S. Pat. No. 4,462,512 also shows means to determine the amount of change due a customer by comparing the price of a selection with the amount of credit accumulated. It also shows the use of a memory to store data regarding each possible coin combination that can be used to provide each amount of change that may be required.

U.S. Pat. Nos. 4,191,999 and 4,347,924 both include means to determine the amount of change to be paid by substracting the sales or vend amount from the amount credited.

Means for determining the availability of coins for changemaking are shown in U.S. Pat. No. 4,587,984 wherein the number of coins directed into and paid out from each tube denomination is used to provide running totals for payout reference. Another such means is shown in the previously referred to U.S. Pat. No. 4,763,769 whereby minimum known levels were indicated by coin tube sensors which were located at specific locations usually near the bottom of each coin tube. Another method for tracking the coins available for payout is shown in U.S. Pat. No. 5,092,816 whereby the coin level for each tube is audited by measuring the time required for a coin to fall from where it enters a coin tube, to when it strikes the coin level present in the tube. U.S. Pat. No. 3,820,642 shows the use of an up-down counter which counter accumulates credit in the count "up" condition, and if the credit is to be returned (Escrow), the counter is placed in the count "down" condition while coins are being paid out until the accumulator returns to the zero amount of accumulation. The above four patents are assigned to the Applicant's assignee.

SUMMARY OF THE INVENTION

The present invention provides that a vend transaction is provided by adding the price of the item selected to each of the change amounts that are listed as permissible, and then determining if any of the additions match the amount that is in credit. When there is such a match, the particular change amount that was added to the selection price to produce the match is used to determine if that amount can be paid from the available change payout tubes. If it can, then a vend is provided and the correct amount of change is returned to the customer. If no match occurs, the total amount of credit can be returned utilizing the least number of coins possible to conserve the smaller denominations for future payout, or, the exact denominations deposited for credit may be returned. It may also be featured that a denomination credited that caused the incorrect change situation can be returned. A "USE EXACT CHANGE" indication would be provided in such situations.

It is an important object of the present invention to provide vend transactions wherein it is determined that the change required to be paid back is both permissible and available.

It is an object of this invention to provide a range of payout amounts that are permissible to make, which range can be easily modified.

It is an object of this invention to determine when a match occurs between the amount entered as credit in a vending machine and the various amounts occurring when the vend price of a selected vend is added to each of the possible change amounts that are permitted to be paid back.

It is a further object of the present invention to provide indications to the customer regarding situations which may affect vend transactions such as insufficient credit, use of exact change, over deposits requiring change amounts which are allowed or disallowed, or amounts which may exceed that of the highest vend selection price available by some predetermined amount.

It is an object of this invention to provide means for vend transactions which have one or many vend prices and with all possible coin denomination combinations that may be used for credit and for changemaking.

It is an important object of this invention to provide various methods for determining the coins that are available for changemaking.

It is also an object of this invention to use a simplified means and method to provide all the above objects.

These and other objects and advantages will become apparent after considering the following detailed description of preferred embodiments in conjunction with the accompanying drawings.

DETAILED DESCRIPTION OF PREFERRED EMBODIMENTS

Figure 1:
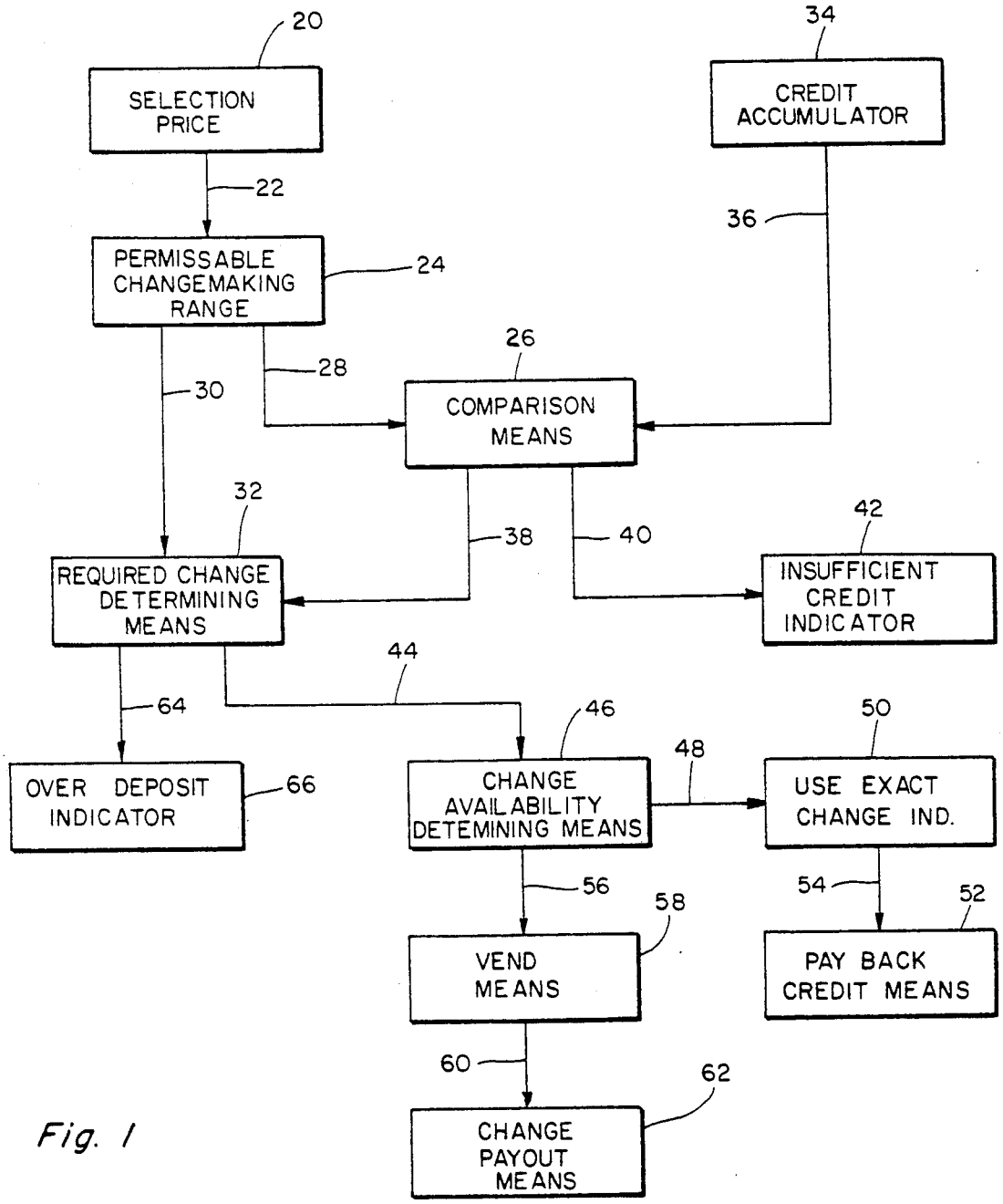
FIG. 1 is a block diagram showing the elements of a preferred embodiment of the present invention.

Referring now to FIG. 1, the price of an item when selected by the customer is provided by Selection Price Means in block 20 which through its output lead 22 is connected to block 24 labeled Permissible Changemaking Range, which block contains means to sequentially add each of its permissible change amounts to the vend price. The sum of each of the additions is provided to block 26 labled Comparison Means by way of output lead 28. Each of the permissible change amounts occurs in sequence and are provided on lead 30 to be monitored by means in block 32 labeled Required Change Determining Means.

A Credit Accumulator block 34 provides the credit amount of a customer's deposit over lead 36 to the Comparison Means block 26, which block presents an output on the lead 38 if a particular sum appearing on lead 28 matches the amount on lead 36 from block 34. An output on lead 40 from the block 26 occurs if the amount of credit on the lead 36 is less than the sum of the vend price when it is added to the permissible change amount of "zero" and thereby causes block 42 labeled Insufficient Credit Indicator to operate. When a match output occurs on the lead 38 the permissible amount of change presented from lead 30 is utilized by the Required Change Determining Means in block 32 to be directed through its output lead 44 to block 46 labeled Change Availability Determining Means, which means look at the change amount indicated as being available in each of the various coin tubes to determine if the permissible and required change amount is available. If the exact amount required cannot be made as change then the output on lead 48 will cause block 50 labeled Use Exact Change Indicator to operate and in so doing will cause payback of the total credit amount by actuating block 52 labeled Pay Back Credit Means. This is done via lead 54.

If on the other hand the exact amount of change can be made, then the output of block 46 appearing on lead 56 will control block 58 labeled Vend Means and through output lead 60 will cause block 62 labeled Change Payout Means to operate.

If no output occurs on the lead 38 during the sequence of permissible changemaking amounts which occur on the lead 30, an output will appear on lead 64 to operate block 66 labeled Over Deposit Indicator.

The control of the Use Exact Change Indicator block 50 and of the Payback Credit Means block 52 may be controlled from output 48 in parallel or in a reversed sequence. The same option may exist in the case of the Vend Means block 58 and the Change Payout Means block 62 under control of a signal on output lead 56.

Figure 2:
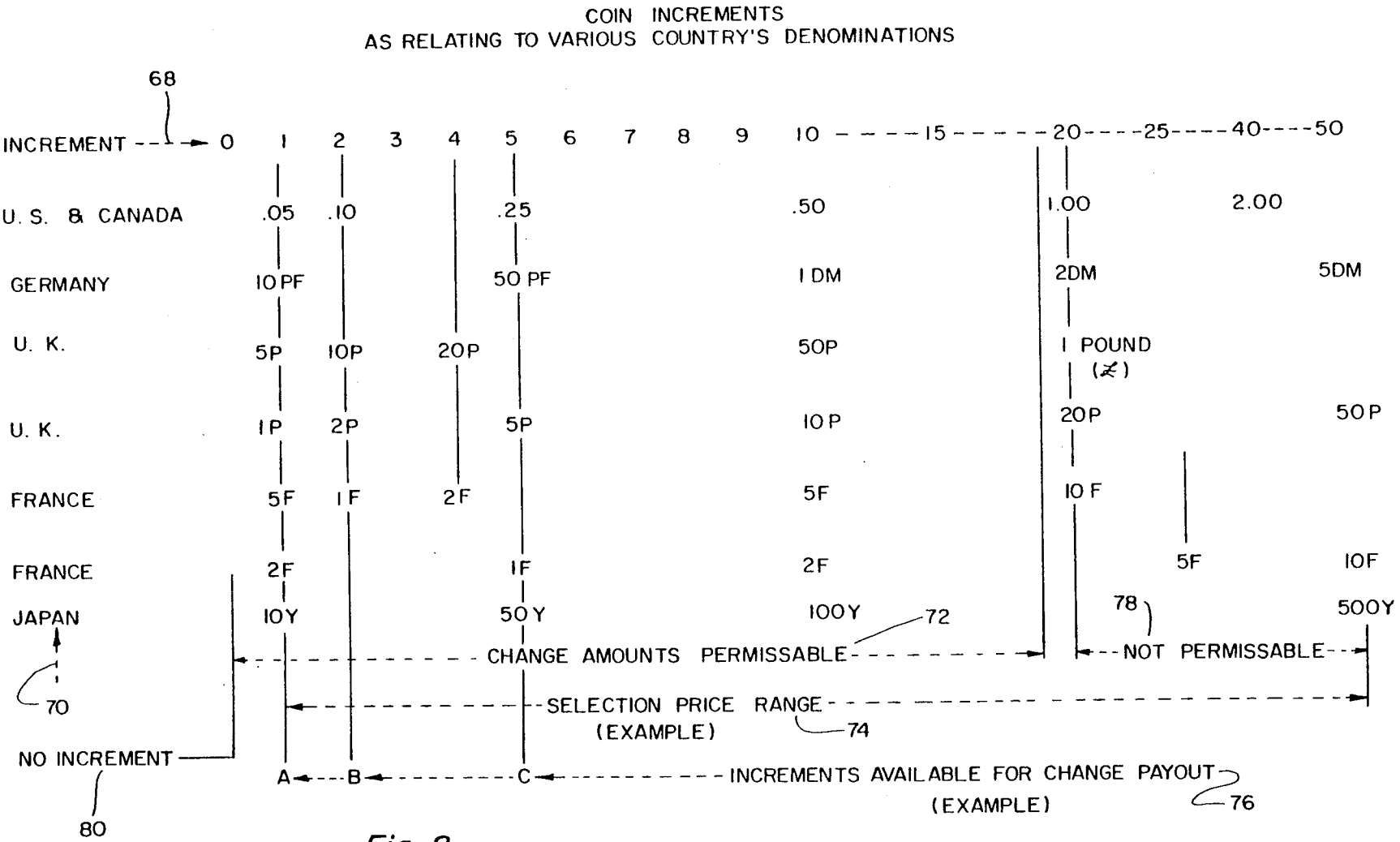
FIG. 2 is a chart showing various combinations of coins from different countries and how their incremental values relate to certain coin denomination sets which may be used for vend transactions.

Referring now to FIG. 2 wherein is shown along the top line 68, coin increments from 0 through 20 and further on to 25, 40, and 50 in increment steps as an illustration of increment assignments that can be given to various of the denomination sets belonging to the countries listed in vertical column 70. The change amounts permissible line 72 in this example represents a range from 0 (none) to 19 ($0.95 for the U.S. and Canadian nickel increments or for 95 p in the first U.K. example). The selection price range 74 example is shown to go from 1 increment through 50 increments (0.05 through $2.50 for U.S. currencies and Canadian currencies and for 10 Y through 500 Y for Japan). In the example shown the line for increments available for change payout 76 is also shown i.e. A, B, and C are increments 1, 2, and 5, respectively (0.05, 0.10 and 0.25 for the U.S. and Canada and 1 p, 2 p and 5 p in the second U.K. example). In this example the not permissible range 78 is for change amounts of 20 (twenty) and higher and would be used to signal the Over Deposit Indicator block 66 of FIG. 1. This is done to prevent excessive payouts which might overly deplete the coins available in the coin tubes.

When the change amount Permissible line 72 is at the No increment 80 (zero) position and zero is therefore added to the selection price, the sum will match (equal) the amount in credit. The change availability determining means 46 will therefore only operate the Vend Means block 58 but not the Change Payout Means block 62.

Figure 3:
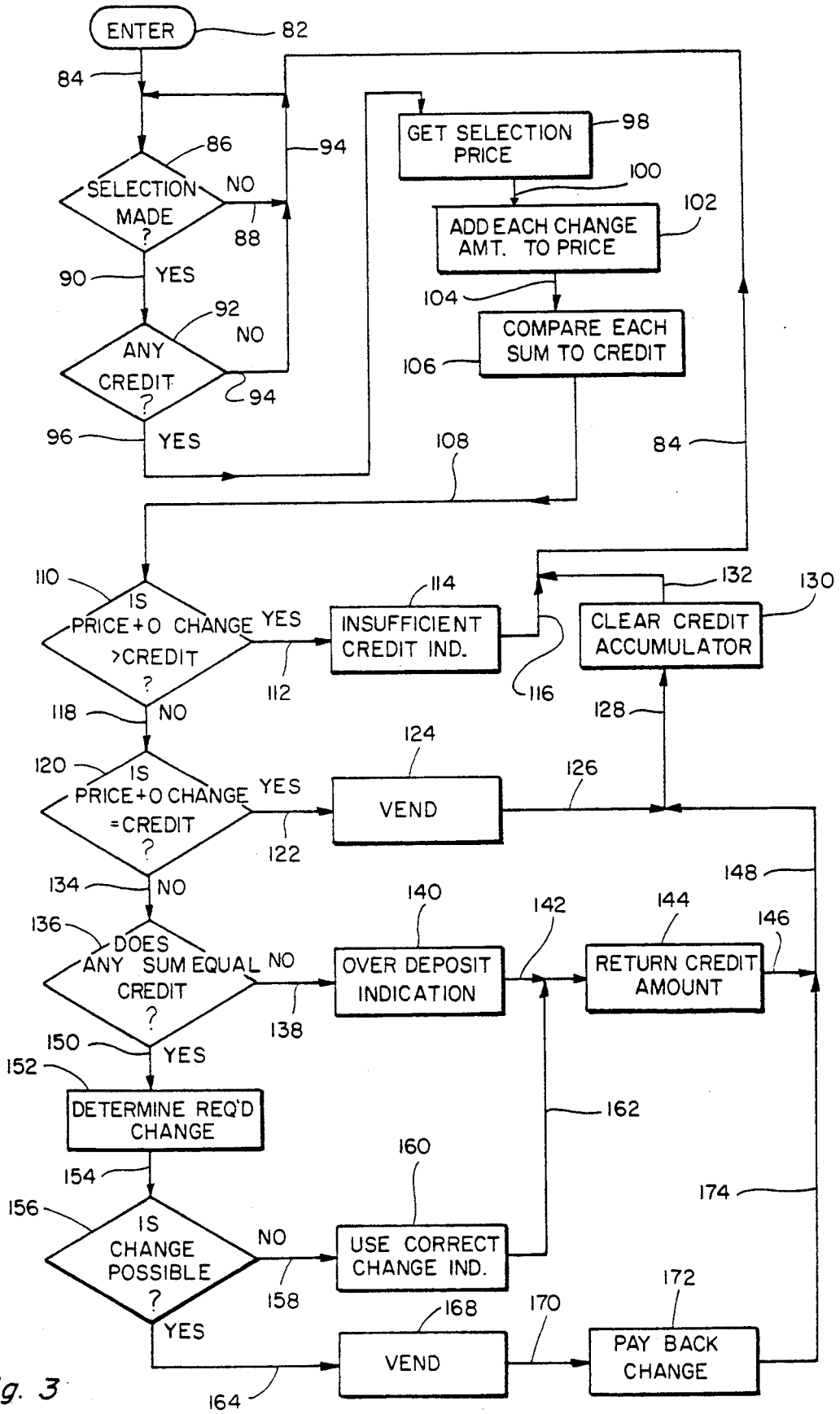
FIG. 3 is a flow chart for a program of the type that may be used with the embodiment of FIG. 1.

Referring now to the flow chart in FIG. 3 wherein the blocks have appropriate legends, and in particular to the enter block 82 where the sequence begins through path 84 to decision block 86. At the block 86 the processing means checks to determine if a selection has been made, and if not, the operational sequence follows the path 88 which connects to path 94 which connects to path 84. If a selection has been made, then the operational sequence follows path 90 to decision block 92. At the block 92 the processing means checks to determine if there is any credit entered. If not, the operational sequence follows path 94 to the entry path 84. If credit has been entered, the operational sequence follows path 96 to the operational block 98, in accordance with which the processing means gets the price associated with the selection indicated by the block 86 and then follows path 100 to block 102.

At block 102 the processing means adds each of the change amounts that are permissible to the vend price that was selected. This range is from 0 (zero) to the highest amount permitted (19) increments as shown as an example in FIG. 2. Each of the sums of these separate additions are provided through path 104 to operation block 106. In accordance with block 106 the processing means compares each sum to the amount of credit deposited, and the operational sequence thereafter follows path 108 to decision block 110. At block 110 the processing means checks to determine whether or not the selection price plus (+) 0 (zero) change amount is greater (>) than the credit. If yes, the operational sequence follows path 112 to operation block 114. The operation block 114 provides an indication (typically a message or light display) to the customer informing the customer that there has been insufficient credit deposited for the selection price that has been made, and the operational sequence thereafter follows path 116 to return to the enter path 84. Otherwise if no, the operational sequence follows path 118 to the decision block 120. At block 120 the processing means checks to determine whether or not the price plus (+) 0 (zero) change amount is equal to the credit amount. If yes, the operation sequence follows path 122 to the vend operation block 124. In accordance with block 124 the processing means causes the vend operation to take place, and the operational sequence thereafter follows path 126 and connects to path 128 to operation block 130. In accordance with block 130 the processing means causes the credit accumulator to be cleared of the amount deposited. The operational sequence thereafter follows path 132 which connects to entry path 84. Otherwise if no, the operational sequence follows the path 134 to decision block 136.

At block 136 the processing means checks to determine if any of the sums is equal to the credit. If not, the operational sequence follows path 138 to operation block 140. In accordance with the block 140 the processing means provides an indication to the customer that he has deposited credit too far above the selection price which excess amount requires a change amount that is not permissible, and the operation thereafter follows path 142 to operation block 144. In accordance with block 144 the processing means returns the credit amount and the operational sequence thereafter follows path 146 which connects to path 148 which connects to path 128 to the operation block 130, in accordance with which the processing means clears the credit accumulator, and then follows the path 132 which connects to the enter path 84. If yes, the operational sequence follows the path 150 to operation block 152.

In accordance with block 152 the processing means determines the amount of change required for the transaction by noting the particular amount of change that was added to the price when its sum equaled the credit, and the operational sequence thereafter follows path 154 to decision block 156.

At block 156 the processing means determines if the coins in the payout tubes are capable of paying back the required amount of change. If not, the operational sequence follows path 158 to operation block 160. In accordance with block 160 the processing means causes the "Use Correct Change" indicator to be activated, and the operational sequence thereafter follows the path 162 which connects to path 142, to operation block 144 which was described earlier, returns the credit amount and by block 130 clears the credit amount. If change is possible, the operational sequence follows path 164 to operation block 168, in accordance with which the processing means causes the vend operation to occur, and the operation sequence thereafter follows path 170 to operation block 172 in accordance with which the processing means will proceed to payout the change amount indicated as permissible and possible. The change can be made utilizing the fewest coins possible to preserve the smaller denominations for subsequent transactions. The operational sequence thereafter follows path 174 which connects to path 148 which connects to path 128 and then to operation block 130 to clear the credit accumulator as was previously described.

Figure 4:
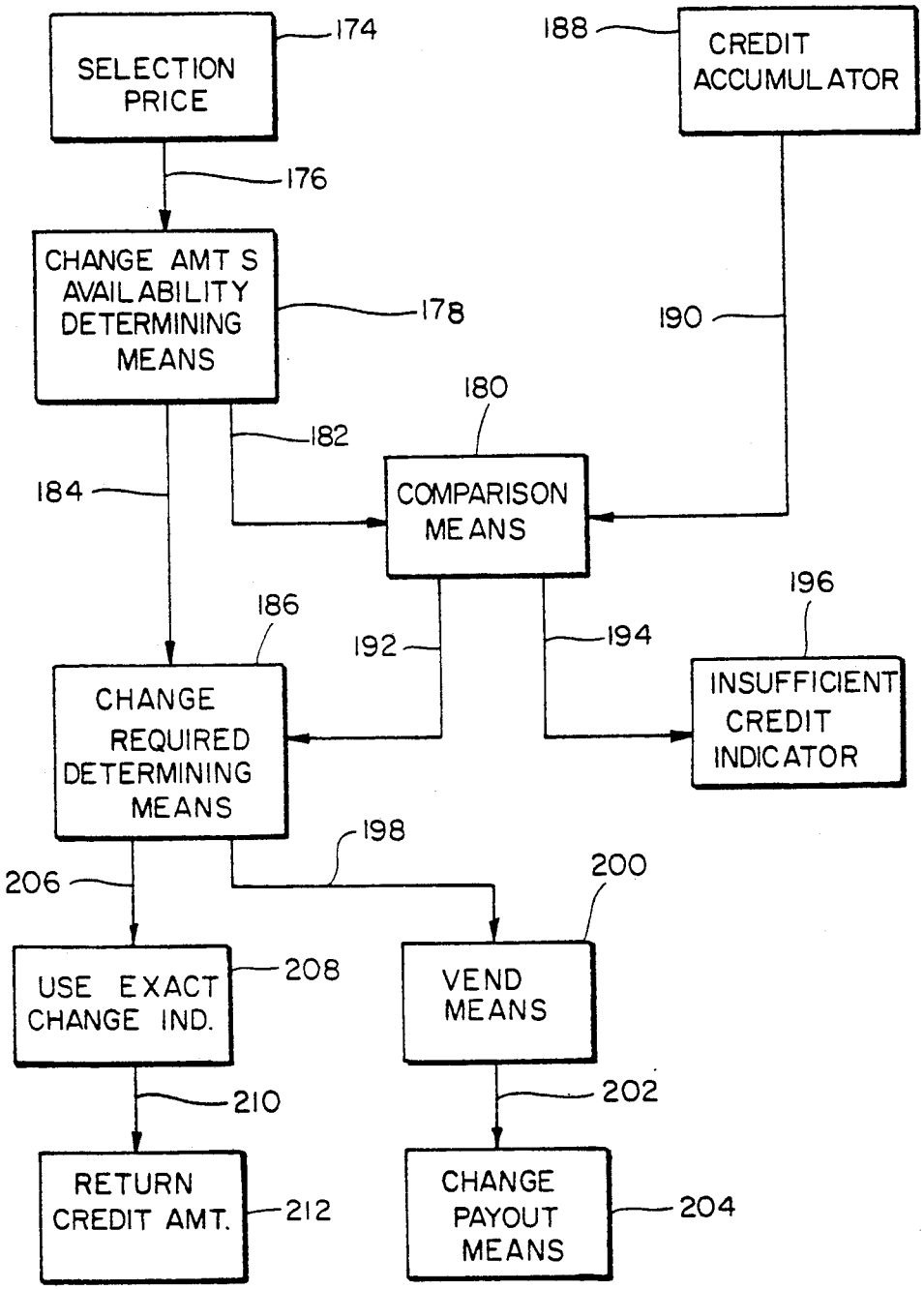
FIG. 4 is a block diagram of another embodiment of the invention.

Referring now to FIG. 4 which shows an alternate embodiment of the invention. The price of an item when selected by the customer is provided by the Selection Price block 174 which, through its output lead 176 connects to the Change Amounts Availability Determining Means block 178 which sequentially adds each of the available amounts to the selected vend price. For example, if there is only one coin determined as available in each of the coin tubes A, B, and C (as shown in FIG. 2) which coins have values of 1, 2, and 5 increments, respectively, the various change amounts available would be 1, 2, 3, 5, 6, 7, 8. Therefore each of these amounts, including 0 (zero), would be added sequentially to the selection price. The sum of each of these additions is provided to Comparison Means block 180 by the output lead 182. The sequential available change amounts are provided on lead 184 to be monitored by the Change Required Determining Means block 186.

The Credit Accumulator block 188 provides the credit amount through lead 190 to the Comparison Means block 180 which presents an output on lead 192 if a particular sum from lead 182 matches the credit received from the lead 190. An output on lead 194 occurs if the credit is less than the sum of the price when it is added to the available change amount of "zero" and thereby will cause the Insufficient Credit Indicator block 196 to operate. When a match output occurs on the lead 192, the particular available amount of change presented from lead 184 is directed through its output lead 198 to the Vend Means block 200. After the vend occurs, its output lead 202 will control Change Payout Means block 204 to payback the amount of change indicated as required. If the amount cannot be made as change then the output lead 206 will cause the Use Exact Change Indicator block 208 to operate and through output lead 210, the customer's credit is returned by operation of Return Credit Amount block 212.

The control of the Use Exact Change Indicator block 208 and the Return Credit Amount block 212 may be controlled by the output on lead 206 in parallel or in a reversed sequence. The same option may exist in the case of the Vend Means block 200 and the Change Payout Means block 204 as controlled by the output on lead 198.

Figure 5:
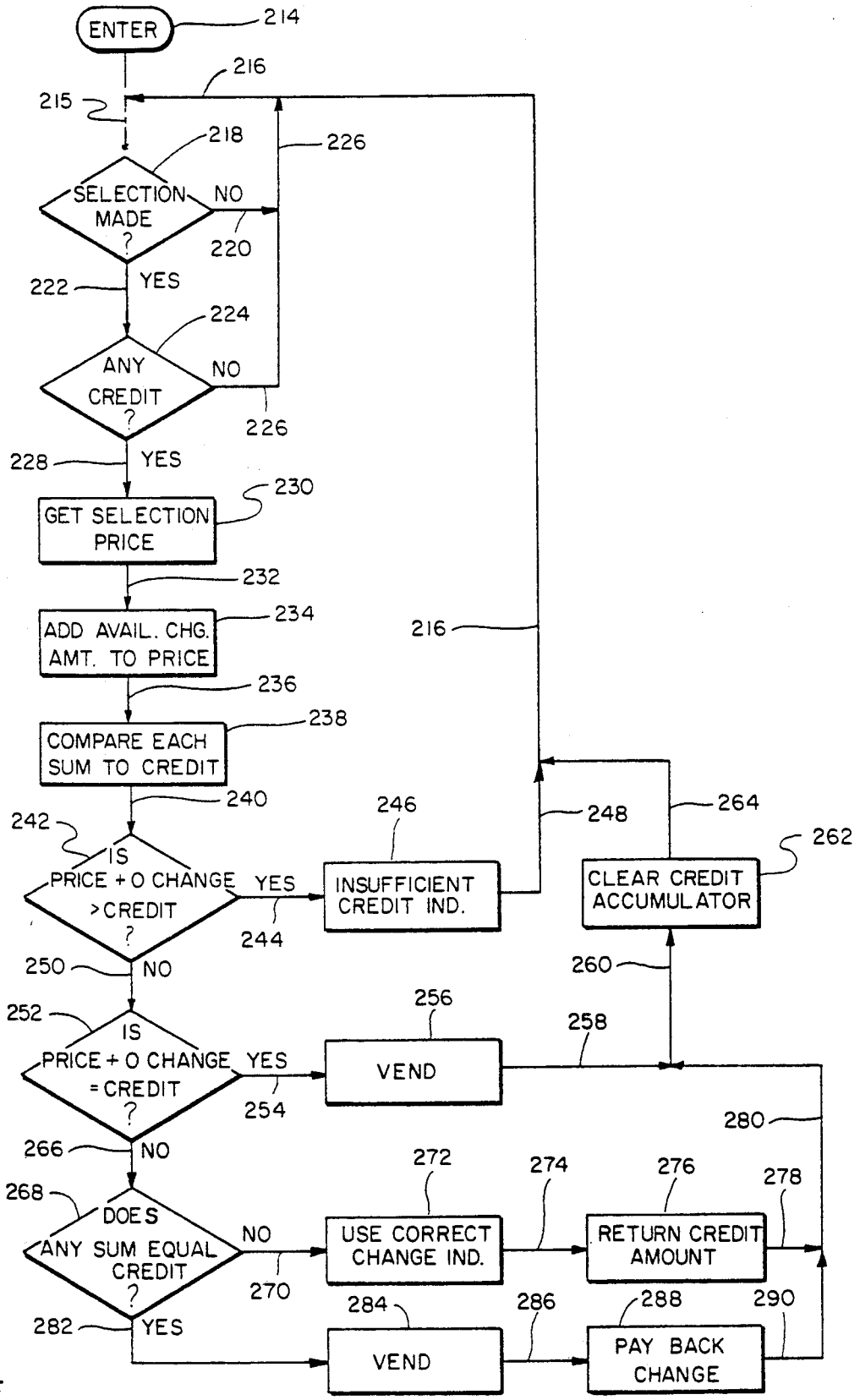
FIG. 5 is a flow chart for the device of FIG. 4.

Referring now to the flow chart in FIG. 5 and in particular to the enter block 214 where the sequence begins through path 215 to the decision block 218. At the block 218 the processing means checks to determine if a selection has been made, and if not, the operational sequence follows the path 220 which connects to path 226, then to path 216 and returns to the path 215. If a selection has been made, then the operational sequence follows path 222 to decision block 224. At block 224 the processing means check to determine if there is any credit. If not, the operational sequence follows path 226 to the entry path 215 via path 216. If so, the operational sequence follows path 228 to the operational block 230 in accordance with which the processing means gets the price associated with the selection indicated by block 230 and then follows path 232 to block 234.

At block 234 the processing means adds each of the available change amounts in the coin tubes to the vend price that was selected. This will range from the 0 (zero) to the highest amoumt allowable (19) increments as shown as the example in FIG. 2. Each of the sums of these separate additions are Provided through path 236 to operation block 238. In accordance with the block 238 the processing means compares each sum to the amount of credit deposited, and the operational sequence thereafter follows path 240 to decision block 242. At block 242 the processing means checks to determine whether or not the selection price plus (+) 0 (zero) change amount is greater (>) than the credit. If yes, the operational sequence follows path 244 to the operation block 246. The operation block 246 provides an indication (typically a meassage or light display) to the customer informing him that there has been insufficient credit deposited for the selection price that has been made, and the operational sequence thereafter follows path 248 to return to the enter path 216. If no, the operational sequence follows path 250 to the decision block 252. At block 252 the processing means checks to determine whether or not the price plus (+) 0 (zero) change amount is equal to the credit amount. If yes, the operation sequence follows path 254 to the operation block 256. In accordance with block 256 the processing means causes the vend operation to take place, and the operational sequence thereafter follows path 258 and connects to path 260 and to operation block 162. In accordance with block 262 the processing means causes the credit accumulator to be cleared of the amount deposited, the operational sequence thereafter follows path 264 which connects to entry path 215 via path 216. If no, the operational sequence follows the path 266 to the decision block 268.

At block 268 the processing means checks to determine if any sum is equal to the credit. If not, the operational sequence follows path 270 to operation block 272. In accordance with the block 272 the processing means provides an indication to the customer that he has deposited credit too far above the selection price which requires a change amount not allowed, and the operation thereafter follows path 274 to operation block 276. In accordance with block 276 the processing means returns the credit amount and the operational sequence thereafter follows path 278 which connects to path 280 which connects to path 260 to the operation block 262, in accordance with which the processing means clears the credit accumulator, and then follows the path 264 which connects to the path 216 and to the enter path 215. If yes, the operational sequence follows path 282 to operation block 284, in accordance with which the processing means causes the vend operation to occur, and the operation sequence thereafter follows path 286 to operation block 288 in accordance with which the processing means will proceed to payout the change amount indicated as possible. The change can be made utilizing the fewest coins possible to preserve the smaller denominations for subsequent transactions. The operational sequence thereafter follows path 290 which connects to path 280 which connects to path 260 and then to operation block 262 to clear the credit accumulator as was previously described.

It will be appreciated by those skilled in the art that the foregoing flow chart configurations illustrate only one, for each of the embodiments, of many possible configurations that could be utilized with a microprocessor controlled vending system to realize the advantages sought by the use of the subject vend transaction determination means. It will also be appreciated that, if so desired, such varied flow chart configurations can generally be implimented in hardwired constructions to the same effect and with comparable results.

It is anticipated that any of the many ways to track or monitor the status of each of the denominations to be used for changemaking or payout, may be employed with the present invention. The number of and value of each of the denomination types to be used in payout may be of nearly any combination that is deemed practical. The denominations may be of coin and/or currency as may be required.

It is anticpated that the denominations used in payout may be returned utilizing the least number of denominations, same denominations inserted, or any other method of credit remuneration.

It is also anticipated that the range of permissable payout may be easily changed as directed by authorized personnel or automatically depending upon either the amount of credit provided, the size of the denomination(s) used for credit, the selection price, or the availability of a particular denomination for payout.

In light of all the foregoing, it will be apparent that there has thus been shown and described a novel coin acceptance means and method which fulfills the various objects and advantages sought therefor. It will be further apparent to those skilled in the art, however, that many changes, modifications, variations, and other uses and applications of the subject coin acceptance means and method are possible and contemplated. All such changes, modifications, variations, and other uses and applications which do not depart from the spirit and scope of the invention are deemed to be covered by the invention, which is limited only by the claims which follow.

What is claimed is:

1. A vend transaction means for a vending system wherein the vend price is added to each of a permissable change amount in a range of changemaking amounts in sequence to provide respective sums thereof, credit accumulation means for totaling the customer deposit, comparison means connected to receive the outputs of said sequenced sums and of said credit accumulation to provide an output relative to any equality thereof, change determining means connected to the outputs of said comparison means and to the output of said permissable changemaking amounts to indicate which of said permissable changemaking amounts was added to the vend price when said comparison means output indicated the equality, change availability determining means connected to receive the permissable change amount from said change determining means which produced the equality, said change availability determining means having a first output where a signal indicating said changemaking availability is produced and a second output where a signal is produced indicating non-availability, means connecting the first output to vend producing means and change payout means, the second output being connected to a means to indicate said non-availability of change and production of credit payback means.

2. In a vending machine having coin tubes of predetermined coin denominations for making change, at least one of the coin tubes having means associated therewith for indicating whether that coin tube has sufficient coins in it to be used to make change, means for making a deposit and accumulating the deposit as credit, means operable by the customer to select a particular vend and to thereby establish a vend price, means to establish a plurality of possible amounts that can be paid back as change, including means to add each of said plurality of possible payback amounts in sequence to the established vend price to establish respective sums thereof, means to compare each of said sums in sequence to the accumulated credit to see if an equivalent condition exists, and means responsive to the existance of an equivalent condition to check to see if coins that are available in the coin tubes are sufficient to make a payback of the change that was required to produce the equivalent condition and if so to produce a vend and a payback operation.

3. In a vending machine having coin tubes of predetermined coin denominations for making change, means associated with selected ones of said coin tubes for establishing minimum amounts of coins therein from which the respective coin tubes can be used to make change, means for accumulating credit based on deposits made by a customer, means operable by the customer to select a vend and to establish a vend price therefor, means to establish a plurality of possible amounts that can be paid back as change, means to add to each of said plurality of possible payback amounts in sequence the established vend price to establish a sequence of the respective sums thereof, means to compare each sums in sequence with the accumulated credit to see if an equivalent condition exists, and means responsive to the production of an equivalent condition to check to see if the coin tubes have sufficient coins in them to payback the amount of change that was added to the vend price to produce the equivalent condition and if so to produce an appropriate vend operation and payback operation.

4. In the vending machine of claim 3 further including means to refund to the customer the amount of the deposits when the coin tubes are unable to payback the amount of payback that produced the equivalent condition.

5. In the vending machine of claim 3 including means to return to the customer the amount of the deposits if the amount of the deposits exceed the vend price by some preselected amount.

6. In the vending machine of claim 3 including means to establish a predetermined range of possible payback amounts for adding to the vend price to produce the sums to be compared to the accumulated credit.

7. In the vending machine of claim 3 wherein the vending machine is capable of vending a plurality of products at different vend prices..

8. In the vending machine of claim 3 wherein there are nickel, dime and quarter payback tubes.

9. In the vending machine of claim 3 including a indicator device to advise a customer to use the exact change for a particular vend, and means to energizes said indicator device when the coin tubes are unable to payback the amount of change required for a particular vend operation based on the accumulated credit.

10. In the vending machine of claim 3 including means to produce a vend operation whenever the amount of change added to the vend price exactly equals the accumulated credit.

11. Means to provide change making in a vending machine when a selection has been made and a vend price established, means to produce a list of possible amounts of change that are permissible to be paid back for change making, means to add the vend price selectively to each of the permissible payback amounts to produce sums thereof, means to compare each of said sums to the amount of credit entered into the vending machine by the customer including means to identify each of said sums that is equal to the credit deposited by the customer.

12. The means of claim 11 wherein the vending machine includes coin tubes for paying back change, at least one of said coin tubes having means to establish a minimum number of coins therein from which change can be made, means to determine the ability of the coin tubes to make change based on the amount of change determined by the production of an equal condition.

13. The means of claim 12 including means to produce a vend operation and a payback operation if the amount of change to be paid back as determined by the equal condition is available from the coin tubes to be paid back.

14. The means of claim 11 including means to establish a range of possible amounts of permissible payback, and means to prevent a change making operation from taking place if the amount of credit entered by the customer exceeds a predetermined maximum amount.

15. Means to produce a vend and payout operation of an excess deposit over the vend price in a vending machine having a vend control circuit that includes means to select a desired vend and to establish the vend price therefor, means to establish a credit value based on the amount deposited by the customer in the vending machine, means to produce a list of permissible payback amounts including means to individually add to the vend price the amount of each permissible payback amount to produce respective sums thereof, means to produce a vend and a payback operation when it is determined that the permissible amount of payback established by comparing the vend price plus one of the permissible payback amounts with the amount deposited produce an equality condition, and means for determining the availability of coins for payback the amount of payback that produced the quality condition.

16. Means to control the vending and paying out of change in a vending machine comprising a vending control circuit including means whereby the customer can make a vend selection, means whereby the customer can deposit coins and establish a credit condition, means to establish a list of permissible change making amounts, means to add each of said permissible change making amounts to the established vend price to produce respective sums thereof, means to compare each of said sums with the credit entered and to produce an output whenever there is equality therebetween thereby establishing the amount of permissible change to be paid back, and means for determining the ability of the vending machine to make the permissible change from coin tube means including means for producing a vending operation and a payback operation if the permissible amount of change is also available in the coin tubes for payback.

17. The means of claim 16 including means to indicate the requirement that exact change be used by the customer if it is determined that the availability of change in the coin tubes is insufficient to payback the exact amount of change required.

18. The means of claim 16 including means for paying back the total amount of credit deposited if the availability of coins in the coin storage means is insufficient to satisfy the payback requirements.

* * * * *